United States Patent [19]

Uyeda

[11] Patent Number: 4,532,785

[45] Date of Patent: Aug. 6, 1985

[54] COMBINATION LOCK

[75] Inventor: Tim M. Uyeda, South San Gabriel, Calif.

[73] Assignee: La Gard, Inc., Torrance, Calif.

[21] Appl. No.: 496,171

[22] Filed: May 19, 1983

[51] Int. Cl.[3] ..... E05B 15/16; E05B 63/00

[52] U.S. Cl. ..... 70/333 R; 70/1.5; 70/322; 70/303 R

[58] Field of Search ..... 70/1.5, 1.7, 321, 322, 70/333 R, 333 A, 303 R, 417

[56] References Cited

U.S. PATENT DOCUMENTS

| | | | |
|---|---|---|---|
| 1,484,692 | 3/1921 | Weber . | |
| 1,956,304 | 10/1930 | Abbott . | |
| 2,494,575 | 1/1950 | O'Brien . | |
| 2,775,115 | 12/1956 | Bremer | 70/322 X |
| 3,045,466 | 2/1960 | Herlong . | |
| 3,339,383 | 9/1967 | Miller et al. | 70/333 R |
| 3,373,583 | 3/1968 | Parrock . | |
| 3,514,982 | 10/1967 | Bergendahl . | |
| 3,668,909 | 6/1972 | Roberts . | |
| 3,906,761 | 9/1975 | Swaim . | |
| 3,968,667 | 7/1976 | Gartner | 70/303 A |
| 3,991,596 | 11/1976 | Gartner | 70/303 A |
| 4,008,588 | 2/1977 | Miller . | |
| 4,222,251 | 9/1980 | Uyeda | 70/333 R |

FOREIGN PATENT DOCUMENTS

| | | | |
|---|---|---|---|
| 201738 | 5/1954 | Australia . | |
| 168173 | 4/1951 | Austria . | |
| 507545 | 11/1954 | Canada . | |
| 327350 | 10/1920 | Fed. Rep. of Germany | 70/417 |
| 426272 | 11/1924 | Fed. Rep. of Germany . | |
| 813817 | 9/1951 | Fed. Rep. of Germany . | |
| 1004065 | 3/1957 | Fed. Rep. of Germany | 70/322 |
| 735148 | 8/1955 | United Kingdom . | |

*Primary Examiner*—Gary L. Smith
*Assistant Examiner*—Thomas J. Dubnicka
*Attorney, Agent, or Firm*—Poms, Smith, Lande & Rose

[57] ABSTRACT

An improved lock assembly having a plurality of peripherally gated tumbler wheels supported within a housing for rotation about a common axis. A peripherally gated control cam is mounted to the tumbler wheel axis to provide cam operated movement of a fence lever and rotatably attached lock bolt between extended and retracted positions when the peripheral tumbler wheel gates are aligned. A single spring is provided for serving the dual purpose of biasing the fence lever towards the control cam and securing the fence lever to the bolt. Further, precise positioning of the lock bolt and lever when the lock bolt is moved to its extended position are provided by a three point positioning configuration in which special surfaces on the lever are moved into abutment with the lock housing. A new relock spring configuration and system is provided for preventing retraction of the lock bolt when the housing backplate is removed.

15 Claims, 11 Drawing Figures

Fig. 8.
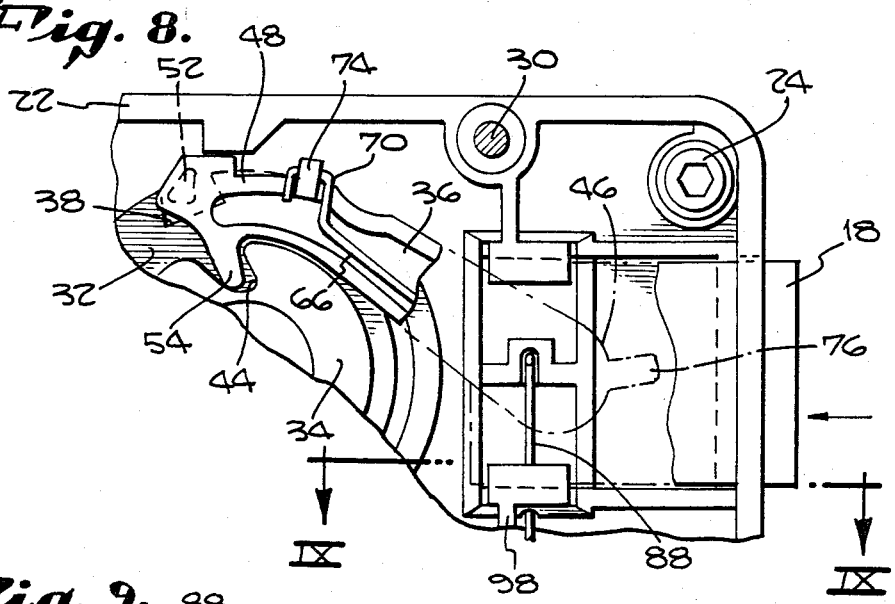
Fig. 9.
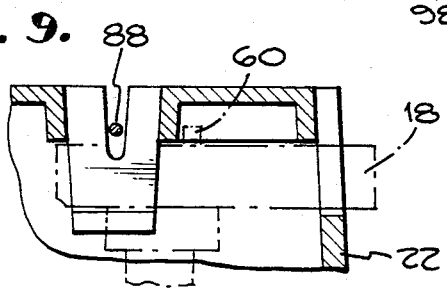
Fig. 10.
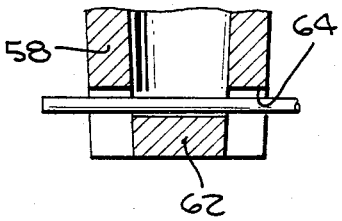
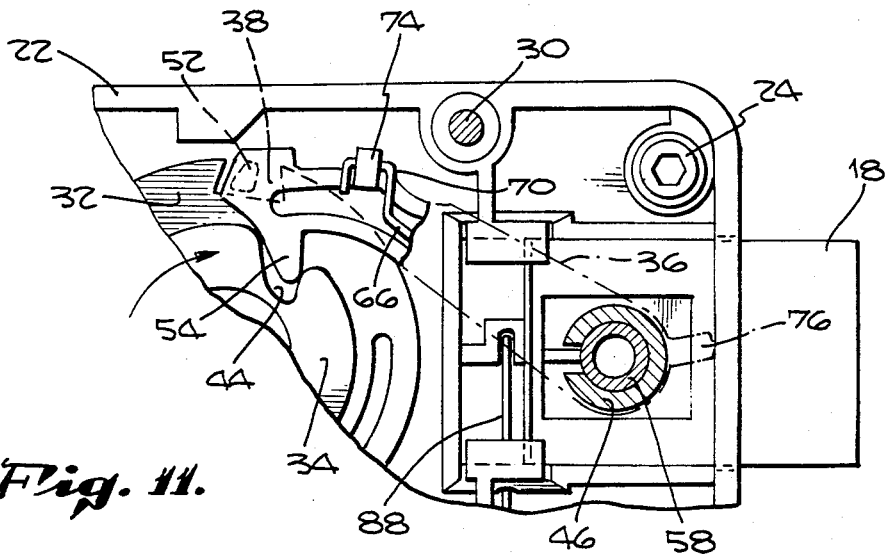
Fig. 11.

COMBINATION LOCK

BACKGROUND OF THE INVENTION

The present invention relates generally to tumbler wheel type lock mechanisms. More particularly, the present invention relates to tumbler wheel type locks for use in high security applications such as securing safe vault doors and other high strength relatively large doors.

Tumbler wheel locks generally include three or more tumbler wheels having peripheral notches or gates. The tumbler wheels are supported for individual rotation about a common axis. A combination wheel or key is used to rotate the tumbler wheels to align the gates. A lock actuation lever is provided having a fence on one end with the other end of the lever being attached to the lock bolt. A control cam is typically mounted on the same common axis with the tumbler wheels. The control cam includes a gate designed to engage a latch on the lever to provide cam operated movement of the lock bolt between extended and retracted positions. The lever is continually biased towards the tumbler wheels and control cam so that the latch continually rides on the peripheral surface of the control cam. The latch can only fall into and engage the gate on the control cam when the tumbler wheel gates are aligned. The control cam gate and latch on the lever are designed so that as the lever and attached latch bolt are extended, the latch is forced out of the cam gate. An example of this type of lock is shown in U.S. Pat. No. 3,991,596 issued to Klaus W. Gartner on Nov. 16, 1976.

Although many of the tumbler locks in existence are well suited for their intended purpose, it still would be desirable to increase the tamper resistance of the locks, simplify the lock mechanism and increase precision with which the lock bolt is extended and retracted to reduce hang up problems experienced during installation and operation of the lock assembly. For example, during installation and operation of the lock, it is important that the extension and retraction of the lock bolt be maintained within close tolerances. Otherwise, possible binding and jamming of the lock bolt may occur. This is especially important for large safe doors where inadvertent jamming of the lock bolt during installation or operation would require structural disassembly of the vault structure. The removal of a jammed lock bolt from large safe doors is many times difficult if not impossible without structurally damaging the vault structure. It therefore is desirable to provide a lock mechanism in which the extension and retraction of the lock bolt is controlled within close tolerances to reduce the chances of inadvertent lock bolt jamming during installation and operation of the lock.

The control cam gate must necessarily be slanted to provide hooking of the lever latch to pull the lever and attached lock bolt to the retracted position. Also, the slanted cam gate is necessary to force the lever latch out of the gate when the lever and attached lock bolt are moved to their extended positions. When the lever latch is forced upward and out of the cam gate upon extension of the latch bolt, the fence on the latch is also moved upward and out of the aligned tumbler wheel gates. Many times it is desirable to retract the latch bolt after an initial latch bolt extension without first scrambling and realigning the tumbler wheel gates. In such cases when the tumbler wheel gates are left in their aligned position after latch bolt extension, the fence tends to hang up on the forward edge of the tumbler wheel gates when the cam gate is realigned with the lever latch for latch bolt retraction. It would be desirable to provide some way of preventing such fence hang ups from occurring.

Most tumbler type combination locks utilize a spring of some type to bias the lever towards the tumbler wheels and cam wheel. Typically, the lever is rotatably mounted to the lock bolt using a standard machine bolt or screw. The lever biasing spring is also mounted on the mounting bolt. During continual extension and retraction of the lock bolt, the bolt or screw used to mount the lever to the lock bolt can eventually vibrate losse and cause jamming and/or damage of the lock assembly. It would be desirable to improve the way in which the lock lever is mounted to the lock bolt and biased towards the tumbler wheels and cam wheel.

Conventional tumbler wheel lock assemblies for high security applications include a high strength housing which includes a removable backplate. When the backplate is removed, access is provided to all portions of the lock housing to allow access for assembly and repair of the lock mechanism. A typical technique utilized by safecrackers to overcome combination locks is to drill through the tumbler wheels and forceably punch the backplate from the housing. Special tools are then used to gain access from the rear of the lock to the lock bolt and other lock assembly parts. To guard against this type of safe cracking technique, relock springs or other relock devices are provided which lock or otherwise connect the lock bolt to the housing when the backplate is removed. It would be desirable to provide an improved relock spring assembly which provides improved blocking of the lock bolt and is tamper resistant.

SUMMARY OF THE INVENTION

In accordance with the present invention, an improved tumbler wheel lock assembly is provided in which the fence lever and lock bolt are precisely positioned during extension and retraction of the lock bolt to reduce lock bolt binding during installation and operation of the lock assembly. The improved lock assembly in accordance with the present invention also provides for improved mounting and spring biasing of the fence lever. Improved relocking of the lock bolt when the housing backplate is removed during attempted safecracking. Further, means are provided to reduce hang up of the lever when the lever latch enters the control cam gate.

The tumbler wheel lock of the present invention is based upon a lock assembly which includes a housing in which a plurality of peripherally gate tumbler wheels are mounted on a common axis for individual rotation. A peripherally gated control cam is also mounted on the same axis as the tumbler wheels. The control cam and gated tumbler wheels are rotated by way of a combination lock dial or keyed actuation. The lock includes a bolt movable between an extended and retracted position for locking and unlocking the lock assembly to various support structures. The lock assembly includes a fence lever having a first end adapted for rotable mounting to the lock bolt and a second end having a fence for engagement with the peripheral gates on said tumbler wheels. The fence lever further includes a latch for engaging the peripheral cam gate only when the fence engages the peripheral tumbler wheel gates. Engagement of the lever latch with the control cam provides cam operated movement of the lock bolt between the extended and retracted positions.

An integral post extending transversely from the lock bolt is provided for rotatably mounting the fence lever first end thereto. In accordance with the present invention, spring means are provided for serving the dual purpose of biasing the fence lever second end towards the control cam while at the same time securing the fence lever first end to the integral post on the lock bolt. Since no mounting bolts or screws are necessary, the present invention effectively prevents any possibility of such screws working loose and jamming extension or retraction of the lock bolt. Further, the dual purpose spring simplifies assembly and operation of the lock without reducing desirable operation characteristics or tamper resistance.

As another feature of the present invention, means for precisely positioning the fence lever and bolt when the bolt is moved to the extended position is provided. The means for such precise positioning of the extended bolt are provided by a detent extending outward from the fence lever first end for abutting against the lock assembly housing to position the bolt in the extended position to prevent further extension of the bolt. Further, an abutment face on the fence lever second end and an abutment shoulder on the housing are provided for contact when the bolt is in the extended position and the latch is disengaged from the control cam gate to prevent movement of the bolt in a retractive direction. As a result, when the bolt is moved to the extended position, it is securely and precisely positioned by the detent, the lever abutment face in contact with the housing shoulder abutment and further, the latch lever is biased against the control cam to thereby provide three positioning points to ensure precise positioning of the bolt in the extended position. This precise positioning feature in accordance with the present invention reduces possible bolt binding and jamming during installation and operation of the lock assembly.

The detent extending from the lever first end not only positions the lock bolt, but also is designed to provide a slight retractive movement of the bolt and lever as the lever latch is moved up and out of the control cam gate. This slight retractive movement prevents the lever fence from hanging up on the forward edge of the peripheral gates in the tumbler wheels when the latch is moved into the gate without first scrambling and realigning the tumbler wheel gates.

As another feature of the present invention, a relock spring is provided which is shrouded from the portion of the lock housing in which the tumbler wheel and control cam are housed. The shroud prevents access by safecrackers to the relock spring by way of the tumbler wheels. A further feature of the relock spring in accordance with the present invention is that it is a simple V-shaped planar spring rod which is positioned to extend behind the lock bolt when the lock bolt is in the extended position. By extending behind the lock bolt, the relock spring effectively prevents retraction of the lock bolt when the backplate is removed. This is an improvement over prior relock springs and devices which are designed to engage indentations in the bolt. The relock spring in accordance with the present invention provides a simplified relock spring configuration in which is simple, reliable and provides positive relocking action.

The above discussed and many other features and attendant advantages of the present invention will become apparent as the invention becomes better understood by reference to the following detailed description which considered in conjunction with the accompanying drawings.

BRIEF DESCRIPTION OF THE DRAWINGS

FIG. 8 is a partial sectional view showing the lock in the retracted position.

FIG. 9 is sectional view of FIG. 8 taken in the IX—IX plane.

FIG. 10 is a sectional view of FIG. 6 taken in the X—X plane.

FIG. 11 is a partial sectional view showing the lock bolt in a position intermediate between the fully retracted and fully extended positions for the bolt.

DETAILED DESCRIPTION OF THE INVENTION

Figure 2:
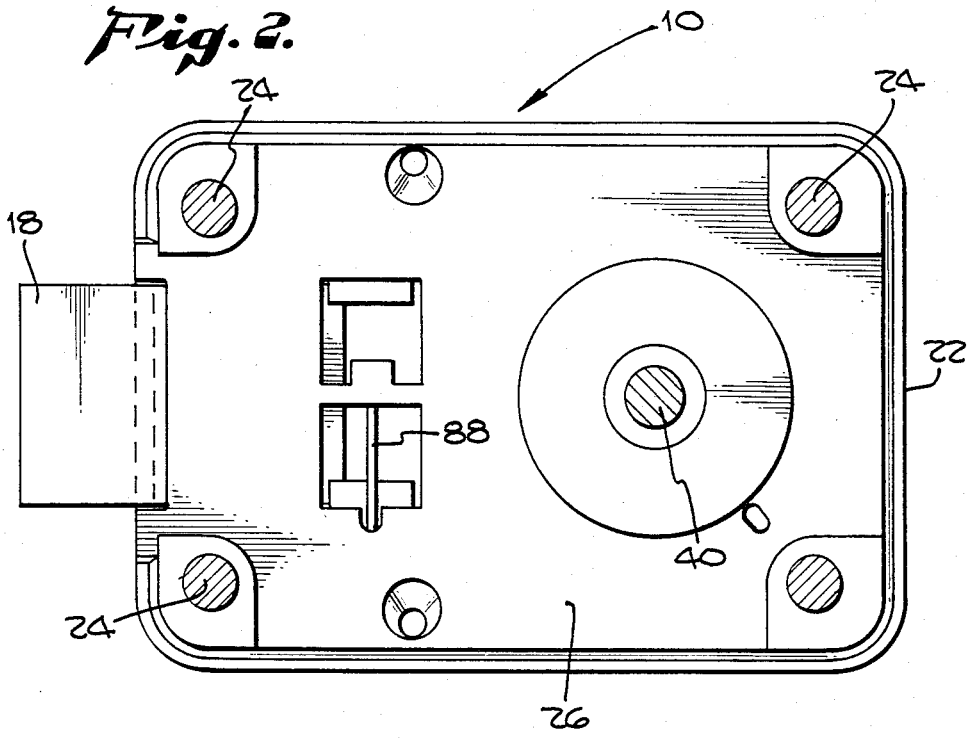
FIG. 2 is a view of FIG. 1 taken in the II—II plane.
Figure 1:
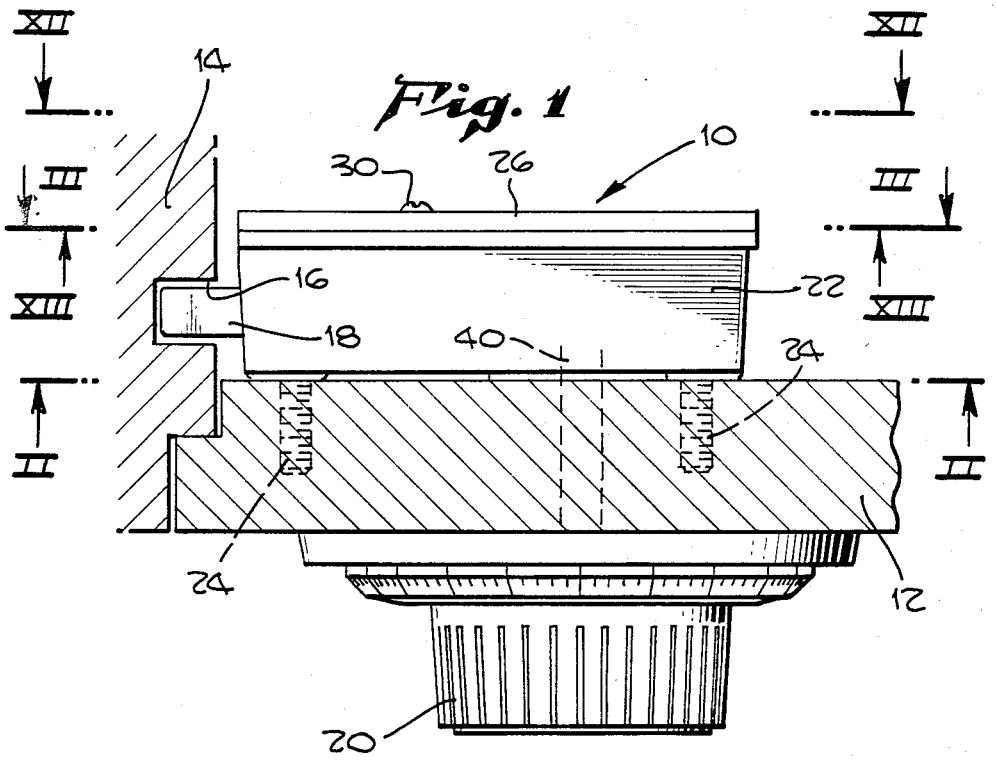
FIG. 1 is a top view showing a preferred exemplary lock assembly in accordance with the present invention mounted to a safe vault door.

A preferred exemplary lock assembly in accordance with the present invention is shown generally at 10 in FIG. 1. The lock assembly 10 is shown mounted to a suitable door, such as safe vault door 12. The vault door is shown in its closed position adjacent the safe wall 14. The safe wall 14 includes a bolt receiving opening 16 into which the lock assembly bolt 18 is inserted to lock the vault door 12 in the closed position.

The lock assembly 10 includes a lock dial 20 which is provided for individually rotating the tumbler wheels to align the tumbler wheel peripheral gates. The combination dial 20 is also provided for operating the cam wheel or disk which moves the fence lever and lock bolt between extended and retracted positions. The use of combination dials to operate tumbler wheels and cam wheels is well known. Key actuation of the tumbler wheels instead of dial actuation is also possible.

Figure 3:
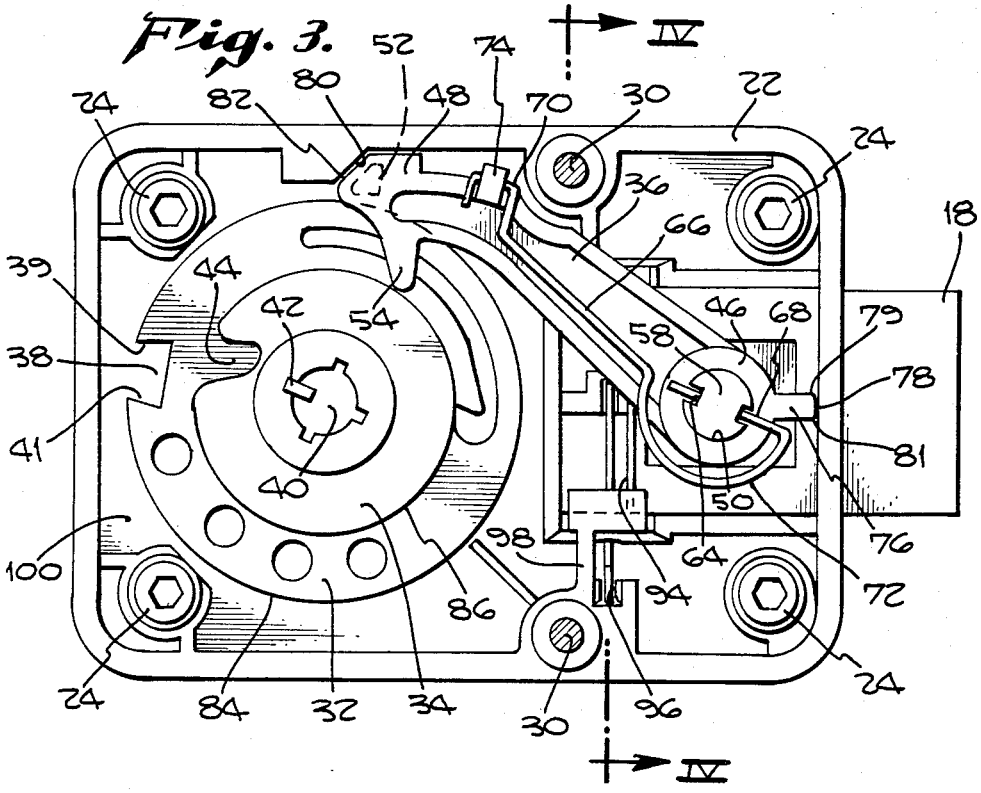
FIG. 3 is a view of FIG. 1 taken in the III—III plane showing the lock assembly with the lock bolt in the extended position.
Figure 4:
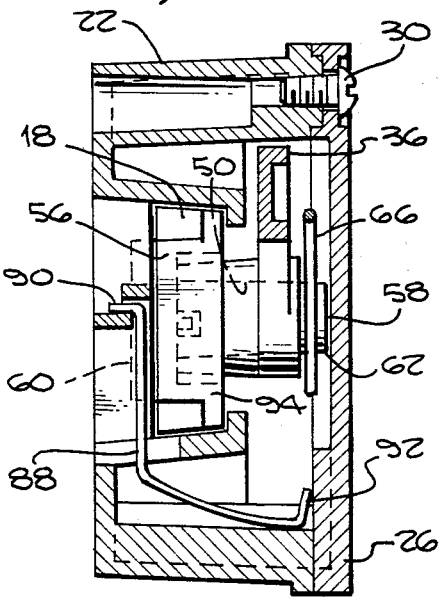
FIG. 4 is a view of FIG. 3 taken in the IV—IV plane showing a preferred exemplary relock spring in the retracted or non-relocking position.
Figure 5:
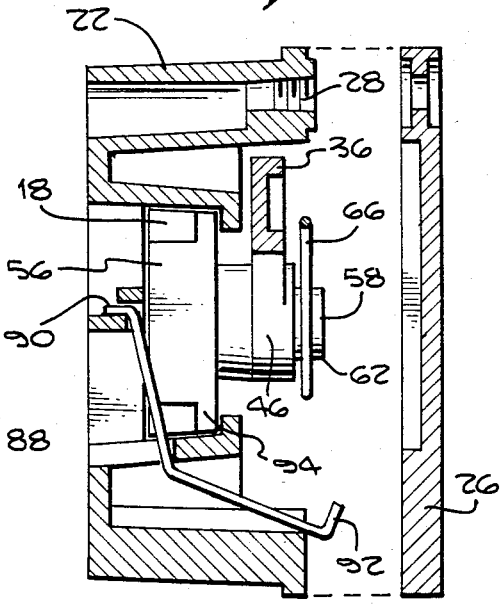
FIG. 5 is the same as FIG. 4 except that the housing backplate is shown removed from the housing and the relock spring is shown in its extended relock position.

Referring now to FIG. 3, the lock assembly 10 is shown with the lock bolt 18 in the extended position. The lock assembly 10 includes a housing 22. The housing 22 is mounted to the desired vault door or other support structure by way of bolts 24 (also see FIG. 7). The housing 22 also includes a removable backplate 26 as best shown in FIGS. 4 and 5. The backplate 26 is secured to the housing 22 at threaded holes 28 by way of fasteners, such as machine screw 30.

Figure 7:
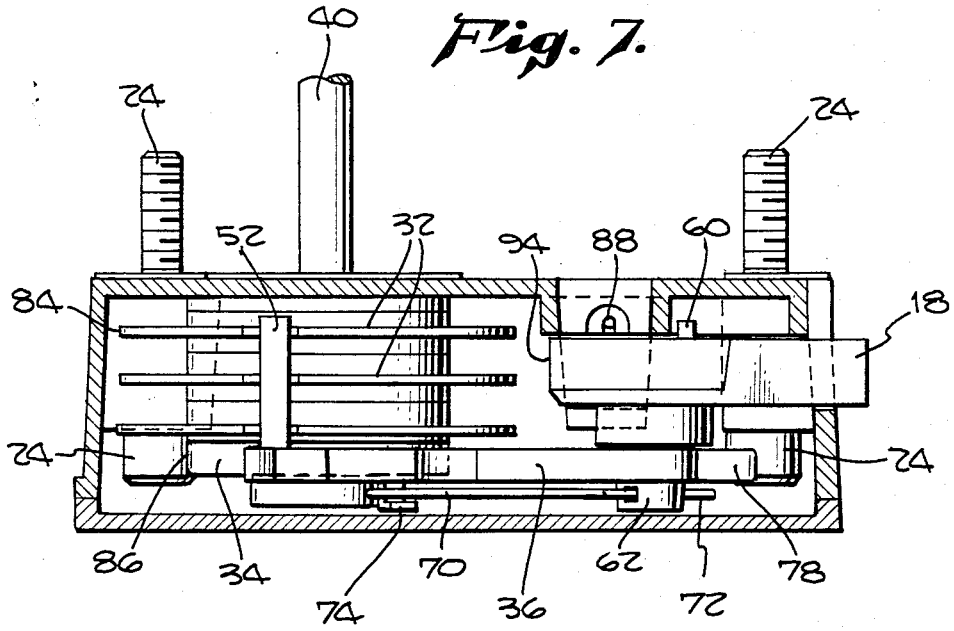
FIG. 7 is a sectional view of FIG. 6 taken in the VII—VII plane.

The four basic elements of the lock assembly housed within housing 22 are the tumbler wheels 32, the control cam wheel 34, the fence lever 36 and the lock bolt 18. The number of tumbler wheels 32 utilized in the lock assembly is not critical. As shown in FIG. 7, three tumbler wheels 32 are preferred. The tumbler wheels include peripheral gates 38. The gates 38 include forward edges 39 and rear edges 41. The tumbler wheels are supported for rotation about a common axis such as rod 40 as is conventional, each of the tumbler wheels 32 is individually rotatable about the rod 40 so that the gates 38 may be aligned to unlock the lock assembly 10.

The control cam wheel 34 is also mounted on the rod 40 with key way 42 being provided so that common rotation of rod 40 and control cam wheel 34 only is possible. The control cam 34 includes a gate 44 which is engagable with the fence lever 36 to provide cam operated movement of the fence lever 36.

Figure 6:
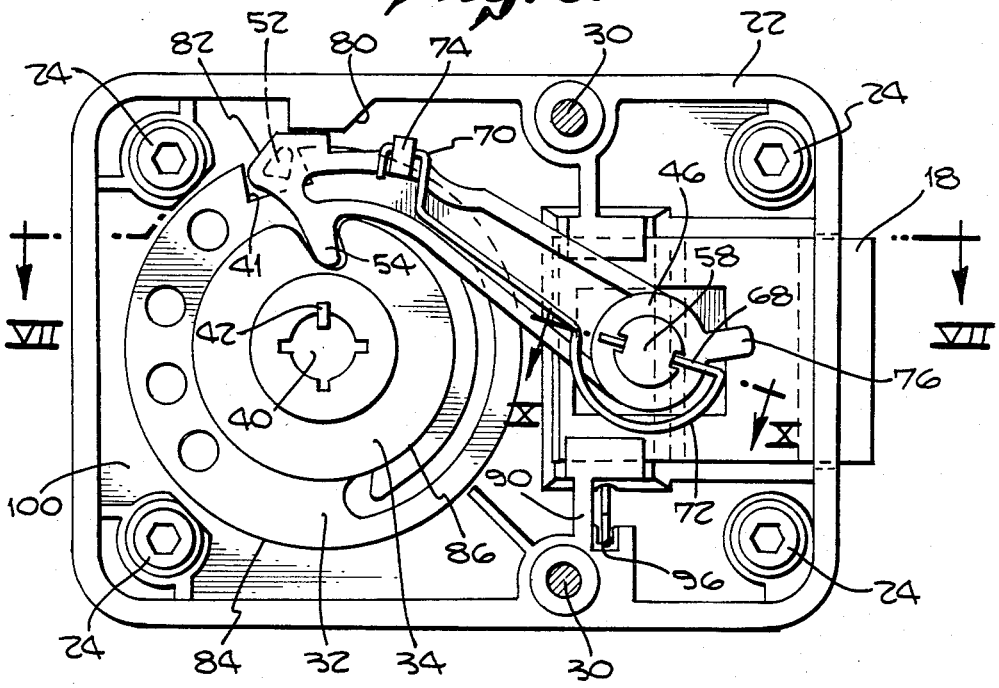
FIG. 6 is the same view of the preferred lock assembly as shown in FIG. 3 except that FIG. 6 shows the lock bolt in the retracted position.

The fence lever 36 includes a first end 46 and a second end 48. The fence lever first end 46 has a surface 50 which defines a transverse opening for rotatably mounting the fence lever 36 to the bolt 18. The fence lever second end 48 includes a transverse tab or fence 52 for engagement with the tumbler wheel peripheral gates 38 when the peripheral gates 38 are aligned as shown in FIGS. 6 and 7. The fence lever second end 48 also includes a nose portion or latch 54 for engagement with the peripheral cam gate 44 when the fence 52 falls into or otherwise engages the peripheral tumbler wheel gates 38. The configuration and co-action between the tumbler wheel and control cam gates 38 and 44 with fence 52 and latch 54 are conventional and well known.

The lock bolt 18 as best shown in FIGS. 3, 5 and 7 includes a relatively retangular lock bar portion 56, and integral post 58 extending laterally from the bar portion 56 and a positioning tab 60 (See FIG. 7). Although the post 58 and bar portion 56 may be machined from a common piece of high strength material such as steel, it is preferred that the lock bolt 18 (including lock bar portion 56 and integral post 58) be formed by casting. The integral post 58 includes a base portion adjacent the lock bar portion 56 and an outer end 62. A passageway 64 is provided through integral post 58 as shown in FIG. 10. Preferably, passageway 64 is molded into the post 58 during casting of the lock bolt. The passageway 64 is provided for mounting the spring means as described below.

Spring means in accordance with the present invention for serving the dual purpose of biasing the fence lever second end 48 towards the control cam 34 and securing said fence lever first end 46 to the post 58 is provided by biasing spring 66. The spring 66 includes a first end 68 and a second end 70. The spring 66 preferably includes arcuate portion 72. As is known, springs having arcuate portions such as arcuate portion 72 provides a more constant biasing pressure throughout movement of the spring than a straight bias spring. Although the biasing spring 66 having an arcuate portion 72 is preferred, the arcuate portion is not absolutely necessary.

The first end 68 of spring 66 is mounted to the post 58 through passageway 64. The passageway 64 is positioned on the post so that when the spring first end 68 is inserted through the passageway, it provides a convenient means for retaining the fence lever first end 46 securely on the post 58. The spring 66 second end 70 is attached to the fence lever 36 preferably at a location near the fence lever second end 48 by way of conventional means such as mounting tab 74. The exact configuration of the spring 66 is not critical so long as it can be securely mounted to the lever by tab 74 or otherwise and additionally can be passed through passageway 64 for mounting to post 58 and retaining fence lever 36 securely upon post 58. It is also important that the spring 66 provides efficient biasing force to bias fence 52 into the aligned gates 38 and also bias latch 54 into gate 44. The spring bias should not be so strong that movement of latch 54 out of cam gate 44 by rotation of cam 34 is not possible or requires a great deal of effort.

Means for precise positioning of the fence lever 36 and lock bolt 18 when the lock bolt is in the extended position as shown in FIG. 3 is provided by detent 76 which is designed to abut against the housing 22 to prevent further extension of bolt 18. The detent 76 includes a contact surface 78. The contact surface 78 may have square edges or curved edges as shown at 79 and 81. The use of detent 76 thereby provides a positioning point to position the lock bolt 18 against further extension. As best shown in FIG. 11, the detent 76 extends from the lever first end 46 so that the detent 76 is slanted upward when said lever latch 54 is engaged with the control cam gate 44. The detent 76 is also sufficiently long and/or the lever 36 sized appropriately so that the detent contact surface abuts against the housing 22 when the lock bolt 18 is in the extended position, but the lever latch 54 has not been forced upward and out of the cam gate 44 as shown in FIG. 11.

An important function of the detent 76 is to provide a slight retractive movement of the lever 36 and bolt 18 when the lever latch 54 moves upward from and out of the control cam gate 44.

As seen in FIG. 11, continued rotation of cam 34 rotates lever 36 about its pivoted axis provided by post 58 in a clockwise direction causing detent 76 to ride along the inner surface of the front wall of housing 22 and push the bolt and lever slightly backward into a predetermined positively located position. This slight rearward movement of the bolt and lever places the fence 52 back over the gates 38 so that the fence 52 may easily enter the gates 38 if the lock dial 20 is returned to a lock opening position without the gates 38 being turned out of their aligned position. This facilitates reopening the lock when it is temporarily locked by only a slight rotation of the dial past a bolt thrown position.

The means for precisely positioning the fence lever 36 and lock bolt 18 also include a second positioning point as follows. Housing 22 includes an abutment shoulder 80 which preferably slopes upward at a 45 degree angle. The fence lever second end 48 includes an abutment face 82 which also preferably slopes upward at a 45 degree angle. As shown in FIG. 3, when the lock bolt is in the extended position and the latch 54 is not engaged with cam gate 44, the abutment shoulder 80 and abutment face 82 are in mating contact. As long as the fence 52 and latch 54 remain on the peripheral surfaces 84 of the tumbler wheels and peripheral surface 86 of the cam wheel 34, the housing shoulder 80 and lever abutment face 82 will be kept in mating contact to prevent any retractive movement of the fence lever 36 or bolt 18. When the tumbler wheel gates 38 and cam gate 44 are aligned, the lever second end 48 may be spring biased into the gates 38 and 42 for retractive movement. The use of the sloping housing shoulder 80 and lever abutment face 82 is designed to prevent inadvertent jamming of the lever against the housing which may be sufficient to overcome the spring bias of spring 66 and thereby effectively prevent the fence 52 and latch 48 from being biased into engagement with their respective gates.

Relock means in accordance with the present invention are preferably provided by a spring such as relock spring 88 as best shown in FIGS. 4 and 5, relock spring 88 is a V-shaped spring rod having a first end 90 secured to housing 22 and a second end 92 which is extendable transversely behind the rear end 94 of bolt 18. Preferably, the first end 90 of the relock spring 88 is bent as shown in FIGS. 4 and 5 to provide a convenient means for securely mounting the spring to housing 22. Any convenient configuration can be used to mount the relock spring 88 to the housing so long as a secure mounting is provided. The relock spring should be made of a suitable high strength steel or alloy typically used for conventional relock springs. It is preferred that the V-shaped spring rod be planar as best shown in FIGS. 3, 8 and 11. The relock spring 88 should be of sufficient size and the V-bend of adequate angle so that when the backplate 26 is mounted to housing 22 as shown in FIG. 4, the relock spring 88 is compressed out of the retraction and extension path of bolt 18. The second end 92 of relock spring 88 is preferably bent as shown to reduce friction and possible jamming of the relock spring when the backplate 26 is removed. This bend is not necessary; however, it is preferred. The relock spring 88 should also be of sufficient size and configuration so that when the backplate 26 is removed as shown in FIG. 5, the relock spring will extend out into the path of the bolt 18 so that the spring will be in a bolt blocking position when the bolt 18 is in the extended position. As shown in FIG. 3, a groove 96 or other retaining means is preferably provided for positioning the relock spring to prevent movement of the spring when the bolt 18 is retractably forced against the relock spring.

As previously mentioned, a typical technique for gaining access to lock assemblies during safecracking is to drill through the tumbler wheels to gain access into the chamber defined by the housing 22. In accordance with the present invention, a shroud means such as wall 98 is provided to prevent access to the relock spring from the tumbler wheel chamber portion 100 of the lock pin.

Having thus described exemplary embodiments of the present invention, it should be noted by those skilled in the art that the within disclosures are exemplary only and that various other alternatives, adaptations and modifications may be made within the scope of the present invention. Accordingly, the present invention is not limited to the specific embodiments as illustrated herein and is only limited by the following claims.

What is claimed is:

1. A lock assembly comprising:

a plurality of peripherally gated tumbler wheels supported for rotation about a common axis;

a peripherally gated control cam mounted to said common axis;

a bolt movable between an extended and a retracted position;

a fence lever having a first end adapted for rotatable mounting to said bolt and a second end having a fence for engagement with the peripheral gates on said tumbler wheels and a latch for engaging said peripheral cam gate only when said fence engages said peripheral tumbler wheel gates to provide cam operated movement of said bolt between said extended and retracted positions;

means for rotatably mounting said fence lever first end to said bolt;

spring means for serving the dual purpose of biasing said fence lever second end towards said control cam and securing said fence lever first end to said bolt;

a housing having a bolt opening through which said bolt is moved between said extended and retracted positions; and means for precisely positioning said fence lever and bolt when said bolt is moved to said extended position, said precise positioning means including a detent extending outward from said fence lever first end having a face for abutting against said housing to position said bolt when said bolt is in said extended position to prevent further extension of said bolt.

2. A lock assembly according to claim 1 wherein said fence lever second end includes an abutment face and said housing includes an abutment shoulder positioned for contact with said fence lever abutment face when said bolt is in the extended position and said latch is disengaged from said control cam gate to prevent movement of said bolt in a retractive direction when said bolt is in said extended position, said detent, lever abutment face, housing abutment shoulder and lever latch biased against said control cam thereby providing three positioning points to precisely position said bolt in said extended position.

3. A lock assembly according to claim 1 wherein said detent extends from said fence lever first end so that the detent is slanted upward when said lever latch is engaged with said control cam gate and wherein cam actuated upward movement of said lever latch out of said cam gate forces said detent face downward and against said housing to provide a slight retractive movement of said bolt and lever.

4. A lock assembly comprising:

a plurality of peripherally gated tumbler wheels supported for rotation about a common axis;

a peripherally gated control cam rotatable about said common axis;

a bolt movable between an extended and retracted position;

a fence lever having a first end rotatably mounted to said bolt and a second end having a fence for engagement with the peripheral gates on said tumbler wheels and a latch for engaging said peripheral control cam gate only when said fence engages said peripheral tumbler wheel gates to provide cam operated movement of said bolt between said extended and retracted positions;

means for biasing said fence lever second end towards said control cam;

a housing having a bolt opening through which said bolt is moved between said extended and retracted positions;

means for precisely positioning said fence lever and bolt when said bolt is moved to said extended position and said latch is disengaged from said control cam gate, said positioning means including:

a detent extending outward from said fence lever first end having a face for abutting against said housing to position said bolt in said extended position to prevent further extension of said bolt;

an abutment face on said fence lever second end; and an abutment shoulder on said housing positioned for contact with said fence lever abutment face when said bolt is in the extended position and said latch is disengaged from said control cam gate to prevent movement of said bolt in a retractive direction when said bolt is in said extended position, said detent, lever abutment face, housing shoulder abutment and lever latch biased against said control cam thereby providing three positioning points to precisely position said bolt in said extended position.

5. A lock assembly according to claim 4 wherein said detent extends from said fence lever first end so that the detent is slanted upward when said lever latch is engaged with said control cam and wherein cam actuated upward movement of said lever latch out of said cam gate forces said detent face downward and against said housing to provide a slight retractive movement of said bolt and lever.

6. A lock assembly according to claim 4 wherein said housing abutment shoulder and lever abutment face slope downward toward said control cam and away from said bolt to prevent jamming of said fence lever against said housing shoulder.

7. A lock assembly according to claim 6 wherein said the slope of said housing shoulder and lever abutment surface is approximately 45 degrees.

8. A lock assembly according to claim 4 wherein said means for biasing said fence lever includes spring means serving the dual purpose of biasing said fence lever second end towards said control cam and securing said fence lever first end to said bolt.

9. A lock assembly according to claim 4 wherein said housing includes a removable backplate, said lock assembly further including relock means for preventing retraction of said bolt when said backplate is removed from said housing.

10. A lock assembly comprising:

a plurality of peripherally gated tumbler wheels supported for rotation about a common axis;

a peripherally gated control cam rotatable about said common axis;

a bolt having a front end and a rear end being movable between an extended and a retracted position;

a fence lever having a first end rotatably mounted to said bolt and a second end having a fence for engagement with the peripheral gates on said tumbler wheels and a latch for engaging said peripheral control cam gate only when said fence engages said peripheral tumbler wheel gates to provide cam operated movement of said bolt between said extended and retracted positions;

means for biasing said fence lever second end towards said control cam;

a housing having a bolt opening through which said bolt is moved between said extended and retracted positions and a removable backplate; and relock means comprising a V-shaped coplanar relock spring rod having a first end secured to said housing and a second end extendable transversely behind said bolt rear end to a bolt blocking position when said bolt is in said extended position and said backplate is removed to thereby prevent retraction of said bolt, said relock spring second end being compressed out of said bolt blocking position when said backplate is mounted to said housing.

11. A lock assembly according to claim 10 wherein said means for biasing said fence lever second end towards said control cam includes spring means for serving the dual purpose of biasing said fence lever second end towards said control cam and securing said fence lever first end to said bolt.

12. A lock assembly according to claim 10 further including means for precisely positioning said fence lever and bolt when said bolt is moved to said extended position.

13. In a lock assembly having a housing with a bolt opening through which a bolt is moved between extended and retracted positions, a plurality of peripherally gated tumbler wheels supported for rotation about a common axis within said housing, a peripherally gated control cam rotatable about said common axis, a bolt movable between said extended and retracted positions and a fence lever having a first end adapted for rotatable mounting to said bolt and a second end having a fence for engagement with the peripheral gates on said tumbler wheels and a latch for engaging said peripheral cam gate only when said fence engages said peripheral tumbler wheel gates to provide cam operated movement of said bolt between said extended and retracted positions wherein the improvement comprises:

a detent extending outward from said fence lever first end for abutting against said housing to position said bolt when said bolt is in said extended position to prevent further extension of said bolt.

14. An improved lock assembly according to claim 13 wherein said fence lever second end includes an abutment face and said housing includes an abutment shoulder positioned for contact with said fence lever abutment face when said bolt is in the extended position and said latch is disengaged from said control cam gate to prevent movement of said bolt in a retractive direction when said bolt is in said extended position, said detent, lever abutment face, housing abutment shoulder and lever latch biased against said control cam thereby providing three positioning points to precisely position said bolt in said extended position.

15. In a lock assembly having a housing with a bolt opening through which a bolt is moved between extended and retracted positions and a removable backplate, a plurality of peripherally gated tumbler wheels supported for rotation about a common axis within said housing, a peripherally gated control cam rotatable about said common axis, a bolt movable between an extended and a retracted position and a fence lever having a first end adapted for rotatable mounting to said bolt and a second end having a fence for engagement with the peripheral gates on said tumbler wheels and a latch for engaging said peripheral cam gate only when said fence engages said peripheral tumbler wheel gates to provide cam operated movement of said bolt between said extended and retracted positions wherein the improvement comprises:

relock means comprising a V-shaped coplanar relock spring rod having a first end secured to said housing and a second end extendable transversely behind the bolt rear end to a bolt blocking position when said bolt is in said extended position and said backplate is removed to thereby prevent retraction of said bolt, said relock spring second end being compressed out of said bolt blocking position when said backplate is mounted to said housing.

* * * * *